United States Patent [19]

Widenbäck

[11] Patent Number: 4,726,172

[45] Date of Patent: Feb. 23, 1988

[54] METHOD AND APPARATUS FOR WRAPPING AN ARTICLE

[75] Inventor: Ralph Widenbäck, Stenungsund, Sweden

[73] Assignee: New Pac Systems AB, Sweden

[21] Appl. No.: 62,715

[22] Filed: Jun. 15, 1987

[30] Foreign Application Priority Data

Jun. 19, 1986 [SE] Sweden ..... 8602741

[51] Int. Cl.[4] ..... B65B 11/04; B65B 11/08; B65B 11/58

[52] U.S. Cl. ..... 53/399; 53/441; 53/449; 53/556; 53/586; 53/587; 53/176

[58] Field of Search ..... 53/176, 211, 399, 441, 53/449, 465, 466, 556, 587, 586

[56] References Cited

U.S. PATENT DOCUMENTS 4,413,463 11/1983 Lancaster ..... 53/586 X
4,563,857 1/1986 Bergling ..... 53/587 X

FOREIGN PATENT DOCUMENTS

2434359C2 5/1986 Fed. Rep. of Germany .
2229669 6/1974 France .
2281275 3/1976 France ..... 53/556
8302313-5 11/1984 Sweden .

*Primary Examiner*—John Sipos
*Attorney, Agent, or Firm*—Ostrolenk, Faber, Gerb & Soffen

[57] ABSTRACT

A conveyor for an article extends between two parallel rolls of stretch film (22, 22') to a turntable (40). The sheets of stretch film (24, 24') on the two rolls are joined together to form a curtain of stretch film. The article is brought into contact with the curtain and the sheets of film are joined together to form a sleeve out of the curtain around the article, thus securing the sheets to the article. The turntable is then rotated, thus winding the sheets several turns around the article. The sheets are then joined to form a new curtain of stretch film, after which the sheets are severed, releasing the wrapped article from this curtain.

4 Claims, 8 Drawing Figures

Figure 1:
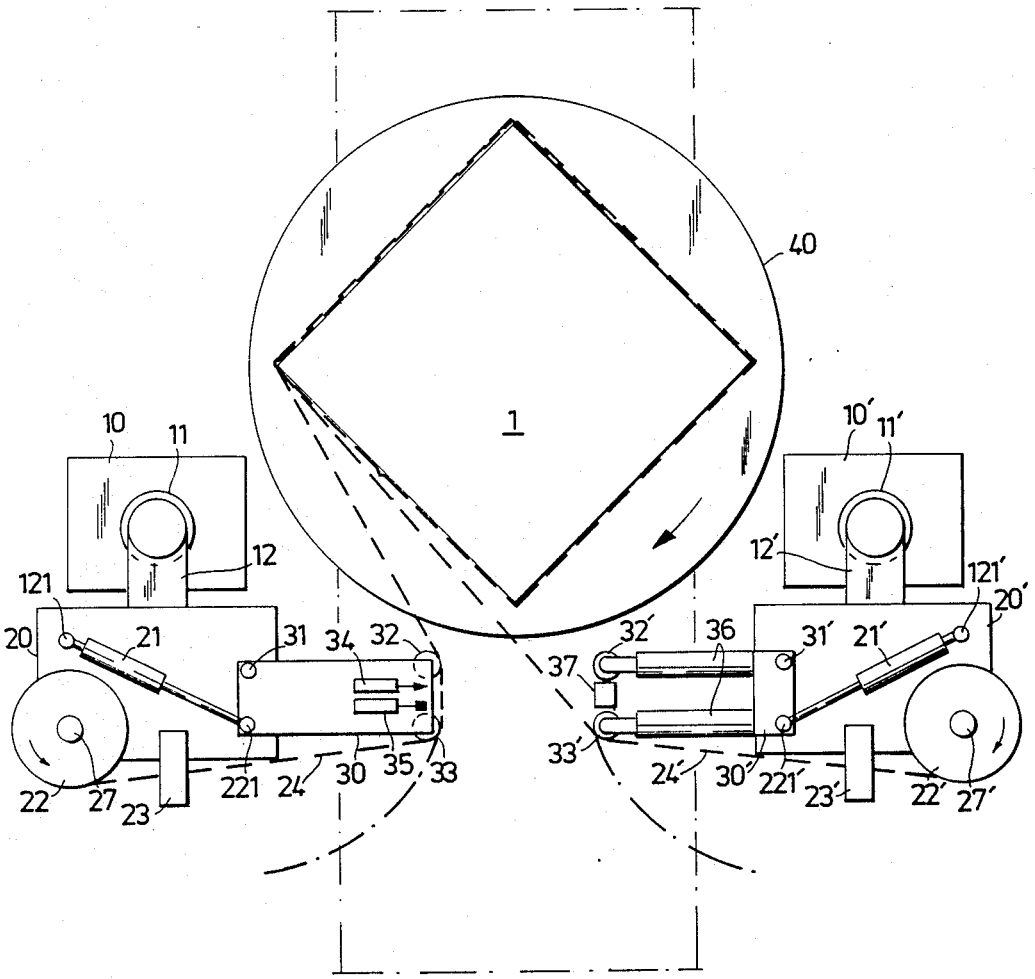

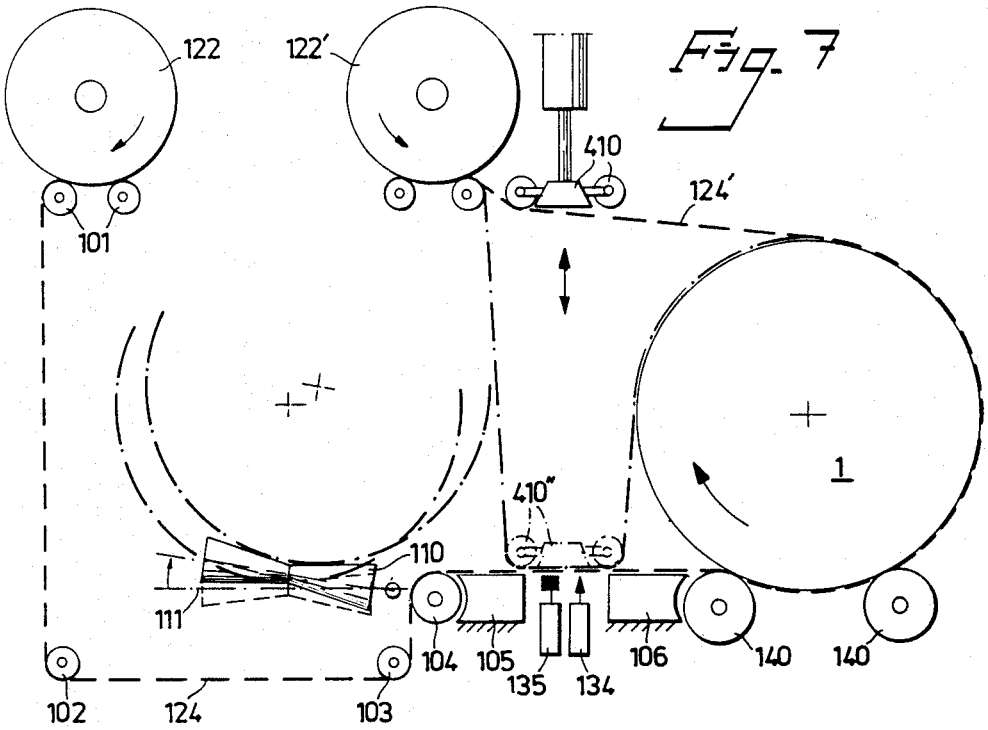
Fig. 7
Fig. 8
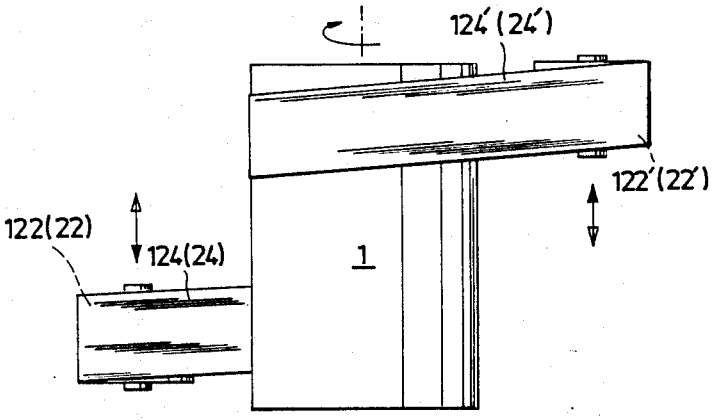

METHOD AND APPARATUS FOR WRAPPING AN ARTICLE

The invention relates to a method of wrapping an article, of the type described in the preamble to the main method claim, and to an apparatus for wrapping an article, of the type described in the preamble to the main apparatus claim.

When wrapping a series of articles in wrapping film such as stretch film, problems occur in getting the sheet(s) of wrapping film to adhere to an article at the start of a wrapping operation. The sheet of film must of course adhere automatically. A clamping arm is generally used for this purpose, which temporarily clamps the sheet of film to the article during the first wrapping turn until it becomes secured to the article by the overlapping layer, after which the clamping arm can be removed. However, the clamping arm is frequently unable to hold the end of the film against the article during the first wrapping turn. Unsuccessful adhesion thus occurs all too often.

The known alternative method of securing the film by clamping the end between two parts of the article, is not always possible.

Neither is the known alternative of securing the end of the film by glueing or using an attachment element always suitable, since this may damage the article.

The known alternative of winding a turn of the film around the article with overlap, before the sheet is severed from, for instance, a ready wrapped article preceding it, introduces another drawback in the form of difficulties in guiding the roll helically, from which the film is being supplied during the first winding turn, or in deflecting the film portion extending between the film supply and the article during the first turn around the article.

Each of the known methods described above thus has certain drawbacks limiting their usefulness, either in the form of limited application, relatively low reliability, relatively high cost or relatively high degree of complexity.

One object of the invention is therefore to provide a method and an apparatus for wrapping an article, by means of which one or more of the drawbacks mentioned above are reduced or eliminated.

The invention is particularly applicable to wrapping articles with stretch film, especially where the article is wrapped in substantially horizontal plane. However, it should be evident that the invention is also suitable for cylindrical goods such as rolls of paper such as those produced in papermills, where the rolls are wrapped in vertical plane while lying with horizontally oriented axis and rotating around this axis.

Further objects and advantages of the invention will be revealed in the following or will be obvious to one skilled in the art.

The method according to the invention is defined in the main method claim. Preferred embodiments of the method are defined in the subordinate claims.

The apparatus according to the invention is defined in the main apparatus claim. Preferred embodiments of the apparatus are revealed in the subordinary claims.

The method according to the invention can be illustrated as follows:

Two rolls of stretch film or other wrapping material with parallel axes are arranged side by side, but spaced from each other.

The sheets of film from the two rolls are joined together to form a curtain of stretch film extending between the two rolls. The article to be wrapped is brought into contact with the curtain.

The curtain is wrapped around the article, adjacent parts of the curtain being joined together to form a curtain/sleeve which, due to friction, is secured against rotation in relation to the article.

The article, together with the two rolls of stretch film are rotated about an axis parallel to the axes of the rolls so that the two sheets of film are wound several turns around the article, thus producing a convenient wrapping material around the article. The outer of the two sheets is preferably of stretch film, most preferably of pre-stretched stretch film.

Thereafter the two sheets are joined together at a point between the wrapped articles and the two rolls.

The two sheets are then severed between the article and the joining point just mentioned. The two ends of the film can now be secured on the wrapped article in conventional manner.

When the two sheets have again been joined, a new curtain of stretch film extends between the two rolls so that a new wrapping operation can be started by forming a sleeve around a new article in a manner preventing it from rotating in relation to the article thanks to the pull exerted on the film sheets during the winding operation.

The method according to the invention necessitates the use of two sheets. This can be exploited by axially displacing the two rolls during the winding operation, possibly independently of each other, to effect the desired coverage of the article in axial direction of the rolls.

At least one of the wrapping films is preferably stretch film. The stretch film is preferably pre-stretched in a pre-stretching unit before being wound around the article. The joint arranged between the portions of the curtain in order to form the sleeve around the article may be effected by heat-sealing, glueing, adhesive tape, deformation—the films being joined together by common deformation—, or in some similar manner. The joint is preferably effected by heat-sealing if the sheets of film consist of suitable material such as stretch film. The joint between the curtain portions, defining the sleeve, will not normally be subjected to particularly great stress either during the initial stage of the winding process or later on. The sheet tension, and thus the stress in the joint between the two sheets of film, can be reduced by pre-stretching a film in the form of a stretch film in a motorised pre-stretching unit, or supplying it by means of a motorised film-feeding unit arranged after the roll of stretch film and before the article to be wrapped. The sheets may be of different material and thickness.

A non-limiting embodiment of the invention will be described in the following with reference to the accompanying drawings, in which FIG. 1 shows schematically a horizontal view of an apparatus according to the invention for wrapping pallet goods, FIGS. 2–6 show consecutive steps when using an apparatus, shown schematically, according to FIG. 1, FIG. 7 shows schematically in side view an alternative apparatus according to the invention, this apparatus being designed for wrapping cylindrical objects, lying horizontally and rotated about their axes, FIG. 8 shows schematically a view taken perpendicular to the plane of FIGS. 1 and 7, and FIGS. 9–12 show horizontal views of consecutive steps in the work cycle of an alternative apparatus according to the invention.

FIG. 1 shows a turntable 40 on which is an article 1, for instance a loaded pallet, to be rotated in the direction of the arrow. Two pillars 10, 10′ are located close to the turntable 40 and spaced apart. The pillars 10, 10′ enclose drive means 11, 11′ such as vertically oriented cylinders, the vertically displaceable portions supporting brackets 12, 12′ which are in turn connected to platforms 20, 20′ which are thus vertically displaceable. Each platform 20, 20′ is provided with an arm 30, 30′ pivotably journalled about a shaft 31, 31′ on the platform. A cylinder 21, 21′ is connected between a fixed point 121, 121′ on the platform and a point 221, 221′ on the arm 30, 30′ separate from the shaft 31, 31′. The arms are thus pivotable from the position shown, where they are directed substantially towards each other, to a position in which they leave clear passage for articles to be wrapped.

Each platform is also provided with a holder 27, 27′ for a roll 22, 22′ of stretch film. A pre-stretching unit 23, 23′ with motorised feed is arranged to prestretch the sheet of stretch film 24, 24′running off the roll 22, 22′. The arm 30′ includes cylinders 36 enabling its length to be varied for reasons to be described later. At its free end the arm 30′ is provided with two guide rolls 32′, 33′ for the wrapping. The arm 30 is also provided at its free end with guide rolls 32, 33 for the wrapping film. The free end of the arm 30 is also provided with a cutting device 34 and a joining device 35. At its outer end, between the guide rolls 32′ and 33′, the arm 30′ is provided with a surface 37 against which the cutting device 34 and/or the welding device 35 are pressed.

The manner in which the apparatus described in FIG. 1 functions will now be described with reference to the accompanying FIGS. 2–6 showing consecutive steps in the work sequence.

It may be assumed that a series of articles, for instance pallet goods, are to be wrapped around their side surfaces and are conveyed to a turntable 40 by a conveyor of conventional type carrying the articles one by one along a path extending horizontally between the pillars 10, 10′ to the turntable 40.

Figure 2:
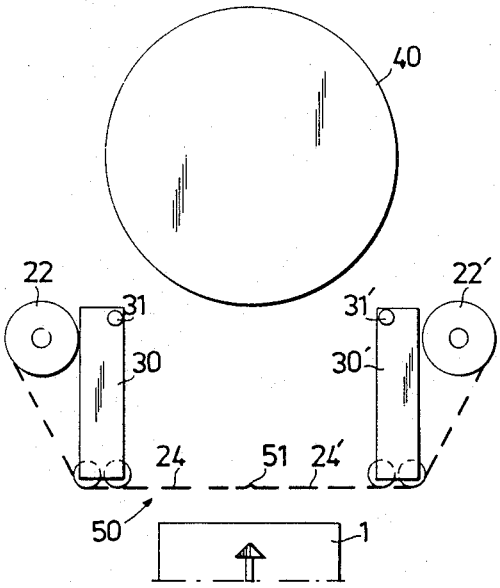

In FIG. 2 an article 1 can be seen travelling in the direction of the arrow, towards a curtain 50 of film material. The curtain 50 is formed by the sheets 24, 24′ of film material coming from the rolls 22, 22′. The sheets 24, 24′ are joined at the joint 51. The arms 30, 30′ are swung out, away from the turntable 40 to allow free passage for the article, for instance to positions in which they are substantially parallel to each other and to the direction of transport of the article 1.

Figure 3:
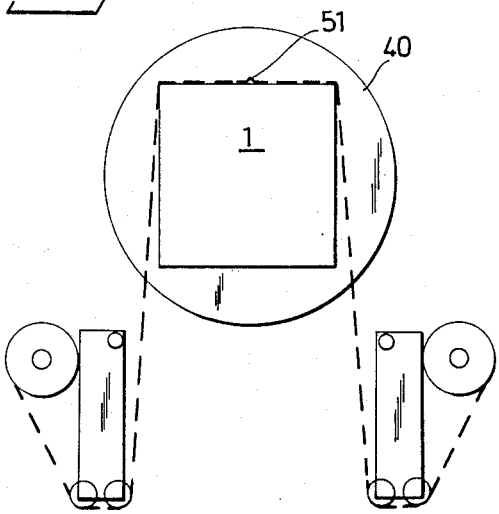
Figure 4:
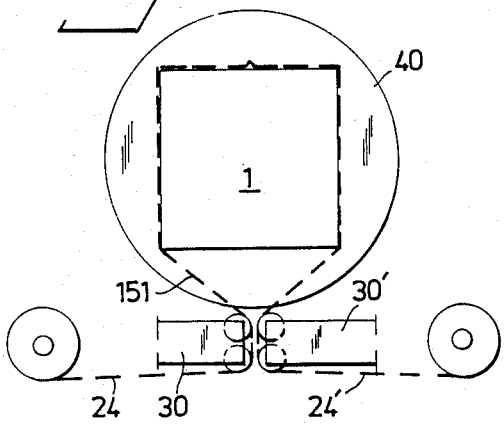
Figure 5:
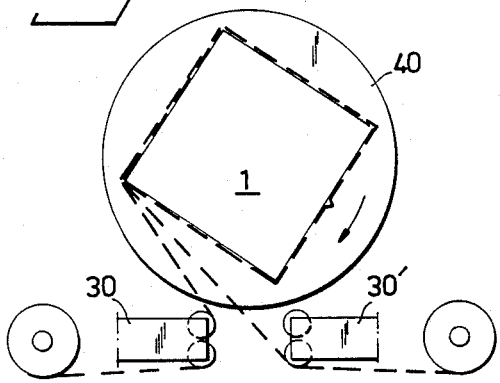
Figure 6:
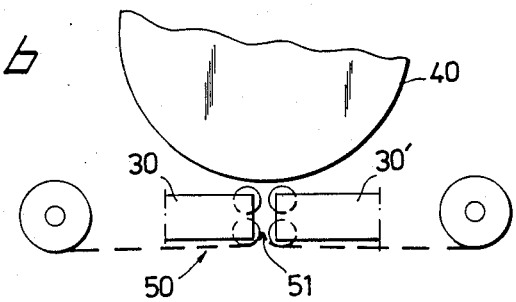

The article 1 is carried towards the curtain 50, carrying it with it so that the sheets 24, 24′ are pulled from the rollers 22, 22′. The article 1 is carried to a position on the turntable 40 as shown in FIG. 3. Thereafter (see FIG. 4), the arms 30, 30′ are swung in close together and the sheets 24, 24′ are moved together, which can be achieved by expansion of cylinders 36 on arm 30′, and joined by the joined device 35. This may be a heat-sealing device, cooperating with the support 37. A sleeve 151 is thus formed out of the sheets of film 24, 24′. A space is then made between the free ends of the arms 30, 30′ and the turntable 40 is rotated, for instance clockwise as seen in FIG. 5. Even with low tensile stress in peripheral direction of the sleeve 151, and even with low friction between the sleeve material and the surface of the article 1, the sleeve 151 will accompany the article 1 as it is rotated. Since at least one of the sheets of film 24, 24′ consists of stretch film, preferably prestretched stretch film, a certain tensile stress will be established in the peripheral direction of the sleeve 151, and the friction between the material of the sleeve 151 and the article is normally relatively high, which in practice results in the sleeve always accompanying the article 1 as it rotates.

During the actual winding process, while the sheets 24, 24′ are being wound several turns around the article 1, the free ends of the arms 30, 30′ are spaced apart so that the sheet 24′, which in FIG. 1 lies between the article 1 and the outer sheet 24′, can be moved in axial direction of the turntable 40 irrespective of the position of the sheet 24 in axial direction of the turntable 40. When the sheets 24, 24′ have been wound several turns around the circumference of the article 1 and have been axially returned to corresponding horizontal level, the turntable 40 is stopped and the two sheets 24, 24′ joined together. Connection can be effected by arm 30′ (see FIG. 1) being extended by expansion of the cylinders 36, and the sealing device 35 activated. The cutting device 34 is activated immediately thereafter. The ends of the sheets 24, 24′ on the wrapped article can now be secured in conventional manner and the wrapped article be removed from the turntable 40 leaving it free to receive a new article 1 for wrapping. The apparatus is then in the position shown in FIG. 6 and it can be seen that the two sheets 24, 24′ are again joined at 51, the joint having been established by the device 35, 37 (FIG. 1), to form a curtain 50, the curtain having been severed from the wrapping on the article 1 by the cutting device 34, 37 (FIG. 1). If the arms 30, 30′ are now swung out from the position shown in FIG. 6, towards the curtain 50, the apparatus will assume the position shown in FIG. 2 and a new article 1 can be carried towards the curtain 50, through the exposed space between the parted arms, to the turntable 40 for a new wrapping operation.

During the winding operation indicated in FIG. 5 the rolls can be displaced independently in axial direction, allowing the thickness of the wrapping around the article 1 to be varied in axial direction of the table. However, it should be evident that the sheets 24, 24′ may have a width corresponding to the exterior of the article. In this case the means 10, 11, 12 for axial displacement of the rolls 22, 22′ are superfluous.

The embodiment of the apparatus according to the invention described above is particularly suitable for wrapping pallet goods and the like, and such goods often require a separate covering sheet over the top surface. This covering sheet must then be sealed to the wrapping around the sides so as to prevent rainwater from leaking in to the article through the joint between top sheet and sides formed by the sheets 24, 24′. With an apparatus designed in accordance with FIGS. 1 and 8 where the width of the sheets 24, 24′ is considerably less than the height of the article 1, a water-tight seal can be effected by simple guide means, between the edges of the covering sheet and the upper edge of the peripheral wrapping of the article 1 produced by sheets 24, 24′. In this case, as shown in FIG. 8, the sheet 24′ is first wound spirally upwards to and partially over the upper edge of the article, and thereafter spirally downwards a short distance, after which the top sheet is applied while the turntable is stationary. Its edges are placed over the wrapping formed by the sheet 24', after which the turntable is started again and the sheet 24' wound spirally upwards again with overlap, covering the edge of said top sheet. This ensures that water falling on the downwardly folded edges of the covering sheet will not easily penetrate inside the peripheral covering formed around the article by the sheet 24'.

FIG. 7 illustrates an apparatus similar to that in FIG. 1 but wrapping the cylindrical surface of an article 1 in vertical plane. The article rests on parallel rollers 140 rotating about its horizontal axis.

It may be assumed that the cylindrical article 1 (for instance a paper roll manufactured in a papermill) is transported horizontally on a roller conveyor, one roller 110 thereof being shown in FIG. 7. The roller conveyor can be pivoted about a horizontal axis 111 located parallel to the longitudinal direction of the roller conveyor. Between the roller conveyor and the support rollers 140 for the article 1 in the wrapping station, are supports 105, 106 and a guide roll 104 for a sheet of wrapping material. Pivoting the conveyor 110 about the axis 111 allows the cylindrical article 1 to roll to the right in FIG. 7, to the position shown.

FIG. 7 shows a roll 122 of sheet wrapping-material. The roll 122 is supported by a pair of parallel rollers 101, allowing rotation about its axis which is parallel to the axis of the article 1. The sheet 124 runs over the righthand roller 101, down below a guide roll 102 and then horizontally below a guide roll 103, up from this and over the previously mentioned guide roll 104. It then continues across the support blocks 105, 106 and on over the lefthand support roller 140. A roll 122' of sheet wrapping-material 124' is also shown, the sheet 124' extending generally downwardly on the righthand side of and below the article 1, but above the two support rollers 140 and is joined to the sheet 124 between the two support blocks 105, 106.

On the upper side of the sheet 124', between the roll 122' and the article 1 carried by the rollers 140 in the winding station, is a unit comprising guide rolls and counter support 410, which is vertically movable as indicated by the double arrow. This allows the sheet 124' to run from the roll 122', be forced vertically down to contact with the joining device 35 and severing device 134, thus enabling either only the sheets 124, 124' to be joined, or the sheets to be both joined and severed in the region between the joining point and the article 1. The joint established by the joining device 135 produces a curtain of material consisting of the two sheets 124 and 124'. This curtain will generally extend between the guide roll 104 and the roll 122'. It will be understood that an article arriving on the conveyor 110 and then being moved to the right in FIG. 7, will then push the curtain to the position shown in FIG. 7. The unit 410 consisting of guide rolls and counter-support can then be moved down bringing the sheets 124, 124' into contact with each other at the joining device 135 which will then join the sheets to form a sleeve around the article 1. The unit 410 can then be raised, for instance to the position indicated by 410'' in FIG. 7, allowing the article 1 to rotate in the direction of the arrow, pulling with it the sleeve, the sheets 124, 124' thus being woun several times around the article 1.

As indicated in FIG. 8, which may be considered to be seen from the left in FIG. 7, the rolls 122, 122' may be axially displaceable allowing the article 1 to be covered along its entire cylindrical surface and partially exceed this, even if the width of the sheets 124, 124' is only a fraction of the axial length of the article 1.

The apparatus according to FIGS. 9–12 comprises a turntable 40 designed to carry goods 1 for rotation in horizontal plane. Sheets of film 224, 224', preferably of stretch film, are wound from separate supplies 222, 222' and may be pre-stretched in a pre-stretching unit arranged in conjunction with the supplies 222, 222'. It may be supposed that FIG. 9 shows the position when an article 1 on the turntable 40 has been wrapped by the sheets 224, 224' and a new article 1 is to be inserted in the direction indicated by the arrow, to a position on the turntable 40.

FIG. 9 also shows two U-shaped elements 71, 72 facing each other and located in the area between the turntable 40 and the supplies 222, 222'. They are movable towards and away from each other in horizontal direction, perpendicular to the direction of feed of the article 1 and in horizontal direction perpendicular to what is to be described in the following. Considering FIG. 9, it may now be supposed that the new article 1' is carried in the upward direction of the arrow in FIG. 9, until it is centered between the elements 71, 72. Devices 34, 35 corresponding to those in FIG. 1 are arranged on the upper leg of the element 71 and a corresponding device 35 is arranged on the lower leg of the element 71. Devices 37 corresponding to those in FIG. 1 are arranged at the ends of the legs of the element 72. The construction is such that when the elements 71, 72 are brought together with the legs opposite each other, the upper legs join the sheets of film and sever them and the lower legs can join the sheets, for instance pointwise by means of spot welding.

Again, considering FIG. 9, it will now be understood that when the article 1' is moved up to a position between the elements 71, 72, these elements can be brought together so that the sheets 224, 224' are joined on both sides of the new article 1' and are cut off outside the new joints, producing the situation shown in FIG. 10. Considering now FIG. 10, the elements 71, 72 can now be raised to push the previously wrapped article 1 from the turntable and replace it by the new article 1' as shown in FIG. 11. From the position shown in FIG. 11, the elements 71, 72 can now be drawn apart and the wrapped article 1 finally removed from the turntable 40, leaving the apparatus as shown in FIG. 12. Here the sheets 224, 224' attached to the article 1' are joined to form a sleeve surrounding the article 1. When the turntable 40 is rotated in the direction of the arrow, sheets 224, 224' will be wound around the article 1 to the desired extent and the elements 71, 72 can be lowered during the winding operation, as shown in FIG. 12, to assume their initial position as shown in FIG. 9.

The elements 71, 72 are particularly useful for articles in the form of stacks with low stability, such as stacks of roof tiles and the like. The stability of the stack is maintained and it can easily be moved along a surface by the elements 71, 72 from a position outside the turntable to a position on the turntable, whereupon the films 224, 224' will be attached to the stack while it is being moved as indicated. Each element 71, 72 can thus be considered to move along a circumferential path, for instance a rectangular path similar to the example shown, in order to achieve the method described. It will be realized that conventional means can be used to effect the desired movement of the two elements 71, 72 and for synchronization of their movement. It will also be understood that the joining and severing devices 34, 35, 37 can be controlled in various conventional ways, well known to the expert.

Three embodiments of the invention have been described above. However, many alternatives are obviously possible.

FIG. 1 shows the two sheets of film controlled by pivotable arms. This embodiment minimizes the space required transversely to the direction of transport, but it should be obvious that the arms 30, 30' could instead be axially movable towards and away from each other when looking at FIG. 1, in order to bring together the sheets of film or to allow the article to be transported through the curtain to the turntable for wrapping or for the sleeve to be formed.

The apparatus according to FIG. 7 illustrates the possibility of applying the apparatus according to the invention in an existing transport system in papermills where the transport systems normally comprise conveyors running substantially at floor level.

The method according to the invention aims at producing a wrapping which will give the desired mechanical protection and/or will keep the article(s) together with sufficient firmness, by winding several turns of a sheet wrapping-material around the article(s).

It is known per se to produce a wrapping around an article by placing the article between two parallel sheets of wrapping material and joining them transverse to their longitudinal extension on opposites of the article to form a sleeve surrounding the article. However, this known technology has been considered to produce a finished wrapping. The method according to the invention makes use of a variation of the abovementioned technology as a preparation for winding the sheets of film several times around the article.

Winding the sheets several times around the article allows the tension in the resultant wrapping to be adjusted to a suitable level to avoid the risk of the joint first established between the sheets being subjected to unsuitable stress. Furthermore, the mechanical protection given by the wrapping can be given requisite thickness or strength irrespective of the thickness of the films selected. The method according to the invention thus constitutes an essential step forward in the technical field of wrapping articles by winding several layers of film around an article, thanks to the instructions provided by the invention on how the two sheets of film can be easily and automatically secured to the article at the start of each winding operation.

I claim:

1. A method of wrapping an article in which two continuous sheets of wrapping material are dispensed from supplies and attached to the article after which the article is rotated several times in relation to the supplies of the sheet material, providing overlap of the sheet material on the article, wwherein joining the two sheets of material together to form a curtain of wrapping material extending between the supplies, wrapping the sheets around the article and joining them together to form a sleeve around the article so that the sheets are attached to the article after which rotating the article to wind the sheets around the article while the sheets are being dispensed from their supplies joining the sheets to each other after the winding operation at a point between the wrapped article and the supplies, to form said curtain, and severing the sheets between the wrapped article and the joining point so that the wrapped article is severed from the curtain, after which a new wrapping operation can be performed, starting with the sheets being brought together and joined to form a sleeve around a new article so that the sheets are attached to this before the winding operation is initiated.

2. A method as claimed in claim 1, wherein the sheets are relatively displaced in the axial direction of the winding axis during the winding operation.

3. An apparatus for wrapping an article comprising of two supplies, each containing a continous sheet of wrapping material, and means for creating relative movement of the supplies around the article to wind the sheets in several overlapping turns around the article while pulling the sheets from the supplies, a first device for joining the sheets together to form a curtain extending between the supplies, means for moving said articles into the curtain and then to the means for creating relative movement while the sheets are being dispensed from their supplies, said first device having a second device to bring the sheets together and join them at a point between the article and the supplies in order to form a sleeve around the article, out of the curtain formed by the sheets of wrapping material, to attach the sheets to the article, and a third device to sever the sheets between the wrapped article and the curtain after winding the sheets around the article.

4. An apparatus as claimed in claim 3, comprising means for relative movement of the sheets in the axial direction of the relative orbital movement of the supplies around the article while the sheets are being wound around the article.

* * * * *